US005600903A

United States Patent [19]

McCray

[11] Patent Number: 5,600,903

[45] Date of Patent: Feb. 11, 1997

[54] BALLAST SHOULDER CLEANER

[75] Inventor: Philip C. McCray, Wetumpka, Ala.

[73] Assignee: Knox Kershaw, Inc., Montgomery, Ala.

[21] Appl. No.: 327,965

[22] Filed: Oct. 24, 1994

Related U.S. Application Data

[63] Continuation-in-part of Ser. No. 130,775, Oct. 4, 1993, Pat. No. 5,459,951.

[51] Int. Cl.[6] ..... E02F 5/22

[52] U.S. Cl. ..... 37/105; 37/104

[58] Field of Search ..... 37/104, 105, 106, 37/107, 233; 171/16; 104/2, 5, 7.1, 12

[56] References Cited

U.S. PATENT DOCUMENTS

| | | | |
|---|---|---|---|
| 1,046,262 | 12/1912 | Cafferty et al. | 37/104 |
| 2,022,150 | 11/1935 | Protzeller | 37/104 |
| 2,886,904 | 5/1959 | Kershaw | 37/104 |
| 3,019,536 | 2/1962 | Kershaw | 37/104 |
| 3,080,665 | 3/1963 | Keller et al. | 37/104 |
| 3,436,848 | 4/1969 | Peppin et al. | 37/104 |
| 3,468,042 | 9/1969 | Coy | 37/104 |
| 3,491,467 | 1/1970 | Finger | 37/104 |
| 3,772,803 | 11/1973 | Cote | 37/233 |
| 4,096,652 | 6/1978 | Raines et al. | 37/281 X |
| 5,052,132 | 10/1991 | Theurer et al. | 37/104 |
| 5,094,018 | 3/1992 | Theurer et al. | 37/104 |

*Primary Examiner*—Terry Lee Melius
*Assistant Examiner*—Victor Batson
*Attorney, Agent, or Firm*—C. A. Phillips

[57] ABSTRACT

A ballast machine for plowing ballast from the outer ends of rail supporting cross ties of a railroad bed. The machine is provided with a ballast ridge plow assembly including a slider box having an inner section which is vertically movable by a hydraulic actuator. The slider box is mounted to the frame of the ballast machine. The ridge plow assembly further includes a blade assembly having ballast engaging blades which are disposed for biased, pivotal movement responsive to engagement of the blades with an obstruction on the railroad bed or cross ties. Means are provided for vertical positioning of the blade assembly and for movement of the blade assembly to an "in and up" position for stowing the blades against the sides of the machine and for movement of the blade assembly to a "down and out" position for the ballast dressing operation. The "in and up" movement and the "down and out" movement are both responsive to displacement of the inner section of the slider box.

14 Claims, 5 Drawing Sheets

BALLAST SHOULDER CLEANER

CROSS REFERENCE TO RELATED APPLICATION

This application is a continuation-in-part of application Ser. No. 08/130,775, filed on Oct. 4, 1993 now U.S. Pat. No. 5,459,951.

FIELD OF THE INVENTION

This invention is directed generally to ballast regulating machines movable along rails on a railroad bed and particularly to ballast regulating machines having resiliently mounted ridge plows for engaging and "plowing" ballast from adjacent to the outside upper surfaces of the cross ties of the railroad bed.

BACKGROUND OF THE INVENTION

It is well known to provide ballast regulating machines to regulate the distribution and shaping of ballast on a railroad track bed. Typically, the machines include plows to distribute the ballast between two track rails as the machine moves along the rails. The rails are fastened to cross ties which are supported on the railroad bed. Such plows which distribute the ballast on the field side (ends of the cross ties which extend outside and away from the tracks) are also known. Some tie plows typically consist of a rigidly mounted blade assembly having a blade which is lowered to a position atop the ends of the cross ties and which engages the upper surfaces of the cross ties as the machine moves along the track. It can be readily seen that if the upper surfaces of the cross ties are not substantially coplanar or if the ties have an upwardly projecting element on its upper surface, the blade is subjected to breaking or bending in response to it striking the uneven surface. Such bending or breaking of the blades require considerable "down time" in order to repair and/or replace damaged blades. Such a replacement is costly both from a standpoint of blade cost plus the cost of the "down time."

Some U.S. patents relating to apparatus for distributing ballast across a railroad bed are as follows: U.S. Pat. No. 3,612,184, issued Oct. 12, 1971, to Franz Plasser et al.; U.S. Pat. No. 4,249,325, issued Feb. 10, 1981, to Josef Theurer; U.S. Pat. No. 4,266,351, issued May 12, 1981, to Emmett W. Cox; U.S. Pat. No. 4,425,969, issued Jan. 17, 1989, to Rolando Naggar; U.S. Pat. No. 4,835,887, issued Jun. 6, 1989, to Josef Theurer; U.S. Pat. No. 5,052,133, issued Oct. 1, 1991, to Pierre Mohr; and U.S. Pat. No. 5,097,608, issued Mar. 24, 1992, to Josef Theurer.

Another type of tie plow assembly (such as disclosed in my co-pending application entitled "Ballast Shoulder Cleaner," filed on Oct. 4, 1993) utilizes a spring-loaded blade assembly and an upper support plate which supports the blades. The blades are mounted in such a manner that while being adjustable in up and down position, they are always extended away from the sides of the machine.

Typically, a ballast broom mechanism is utilized to follow the tie plows to further aid in "dressing" the ballast bed. The ballast broom mechanism cleans any remaining ballast from the top of the ties which extend outwardly from the rails and from around the field side of the rail area. The ballast broom mechanism includes a first broom assembly which is mounted on a horizontal shaft and rotatable to sweep the top of the ties outside the rail. The "horizontally mounted" broom assembly utilizes a spiral reel having the sweeping elements attached thereto for sweeping the ballast to the outside of the track shoulder. The second broom assembly is mounted to a vertical shaft. This "vertical shaft broom assembly" sweeps along the outside of the rail base, cleaning the rail base and the tie plate area. As this vertical shaft rotates, it discharges some of its rocks forward into the first broom assembly (horizontal shaft broom assembly), which sweeps them to the outside. Other rocks are carried directly to the track shoulder by the vertical broom assembly.

The rocks that are swept from the tops of the cross ties are deposited on the track shoulder and build up upon one another to form a ridge adjacent to and beyond the ends of the cross ties. Apparatus of the present invention provides for "dressing" these ridges by "flattening out" these ridges to provide well-dressed shoulders at the ends of the cross ties.

It is, therefore, an object of the present invention to provide a ballast "dressing" apparatus (ridge plow) which distributes and dresses ballast on a railroad track bed on the outside of the rails.

It is another object of the present invention to provide such a ridge plow with a blade assembly having at least one vertically extending blade disposed for predetermined angular relation with the rails to move ballast away and to the outside of the rails.

It is still a further object of the present invention to provide such a plow assembly with means to provide up and down movement thereto.

It is yet another object of the present invention to provide such blade assembly with means to extend and retract the blade assembly away from and adjacent to the sides of the ballast machine responsive to the downward and upward movement of the blade assembly.

These and other objects of the present invention will become more readily apparent from an understanding of the following drawings and description.

BRIEF DESCRIPTION OF THE DRAWINGS

FIG. 2 also illustrates a ridge plow in its "up" and inwardly retracted (stowed) position adjacent to the frame of the machine. Such position permits the ridge plow assembly to be safely stowed during transportation of the machine.

FIG. 6 also illustrates two spring-biased blades.

DESCRIPTION OF THE PREFERRED EMBODIMENT

Figure 1:
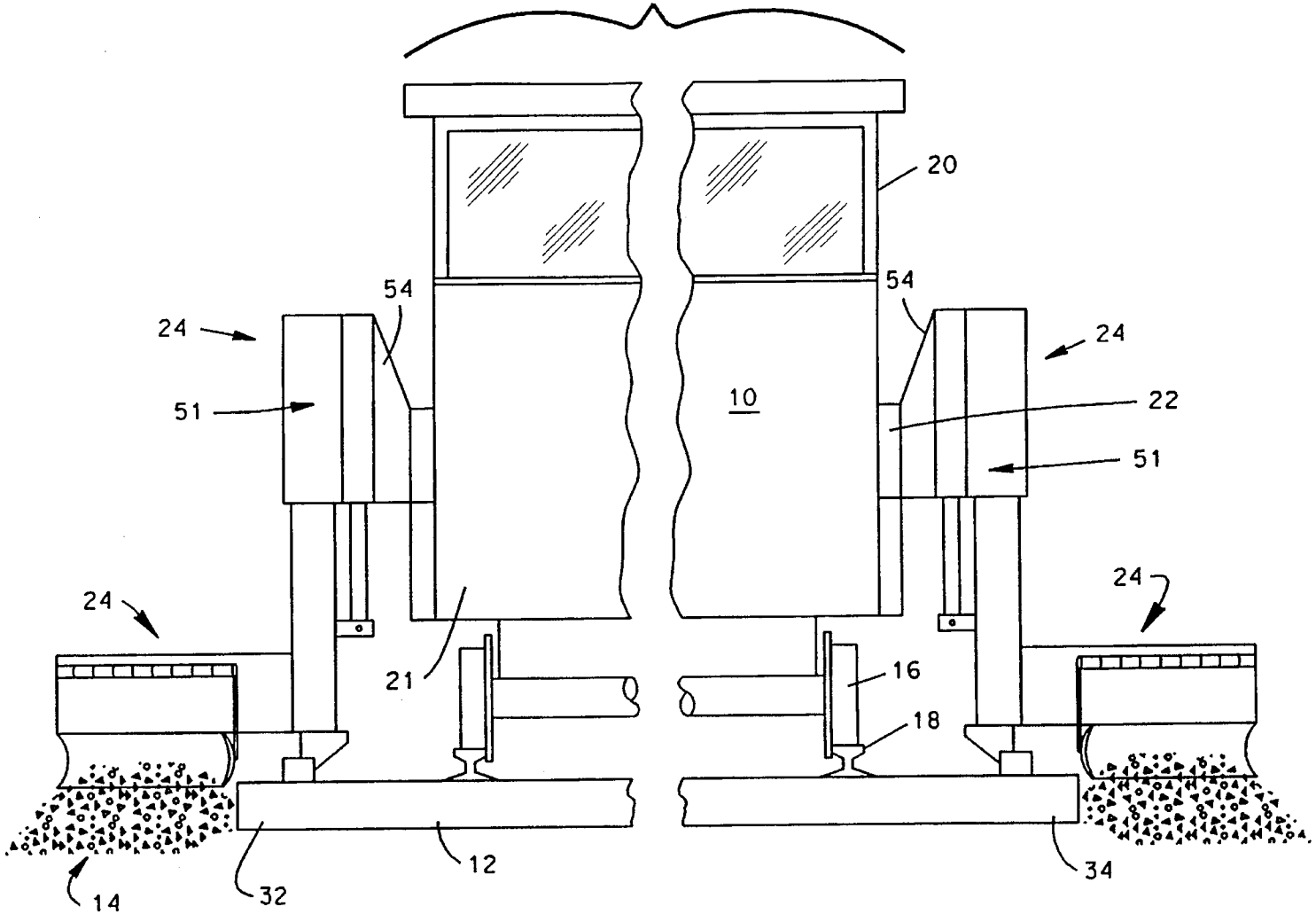
FIG. 1 is a front elevational view of a ballast shoulder cleaner machine illustrating the ridge plows of the present invention mounted on opposite sides thereof.

A track working machine 10 for dressing the ballast deposited adjacent to the ends of cross ties 12 mounted on a railroad track bed 14 is illustrated in FIG. 1, which is a front elevational view of machine 10. The machine 10 is supported on track engaging wheels 16 which support machine 10 for movement along rails 18. The machine 10 includes an upper portion 20, a lower portion 21, and a main frame 22. The machine may be self-propelling, if desired, or may be non-self-propelling, in which case it would be hooked (connected) to a separate driving machine which would provide the propelling force for the non-self-propelling track working machine 10. In either case, various components of a ridge plow assembly 24 are provided to engage and remove the ballast from and adjacent to the ends of the cross ties. The ridge plow assemblies include blade assemblies and are connected to a fluidic actuating system which supplies fluid pressure for vertical movement of blade assemblies whereby, responsive to this vertical movement of the blade assemblies, the blade assemblies are moved between a retracted portion (where the longitudinal axis of the blades is substantially parallel to the frame of the ballast machine) to an extended portion (where the longitudinal axis of the blades is extended away from the frame of the machine and in angular relation therewith).

The pair of ridge plow assemblies 24 which are shown on opposite sides of machine 10 in FIG. 1. The ridge plow assemblies 24 cooperate with a previously used ballast sweeping mechanism as discussed supra to "dress" the ballast relative to the ends of the cross ties 12 and track bed 14.

FIG. 1 is a partial front elevational view of the shoulder cleaning machine 10 and illustrates a pair of ridge plow assemblies 24, each respectively mounted on opposite sides of machine 10. Ridge plow assemblies 24 are identical except one is right-handed and the other is left-handed. As can be seen in FIG. 1, each ridge plow is extended to a position adjacent to the outside ends 32 and 34 of the cross ties 12. The ridge plow assemblies are capable of being raised and lowered and movable between a retracted position adjacent to the frame of machine 10 and an extended operational position away from the frame of machine 10, as will be described hereinbelow. Each ridge plow assembly includes a single actuating assembly such as a slider box and a linkage arrangement to provide for the raising, lowering, extending, and retracting of the plow assemblies 24.

Figure 2:
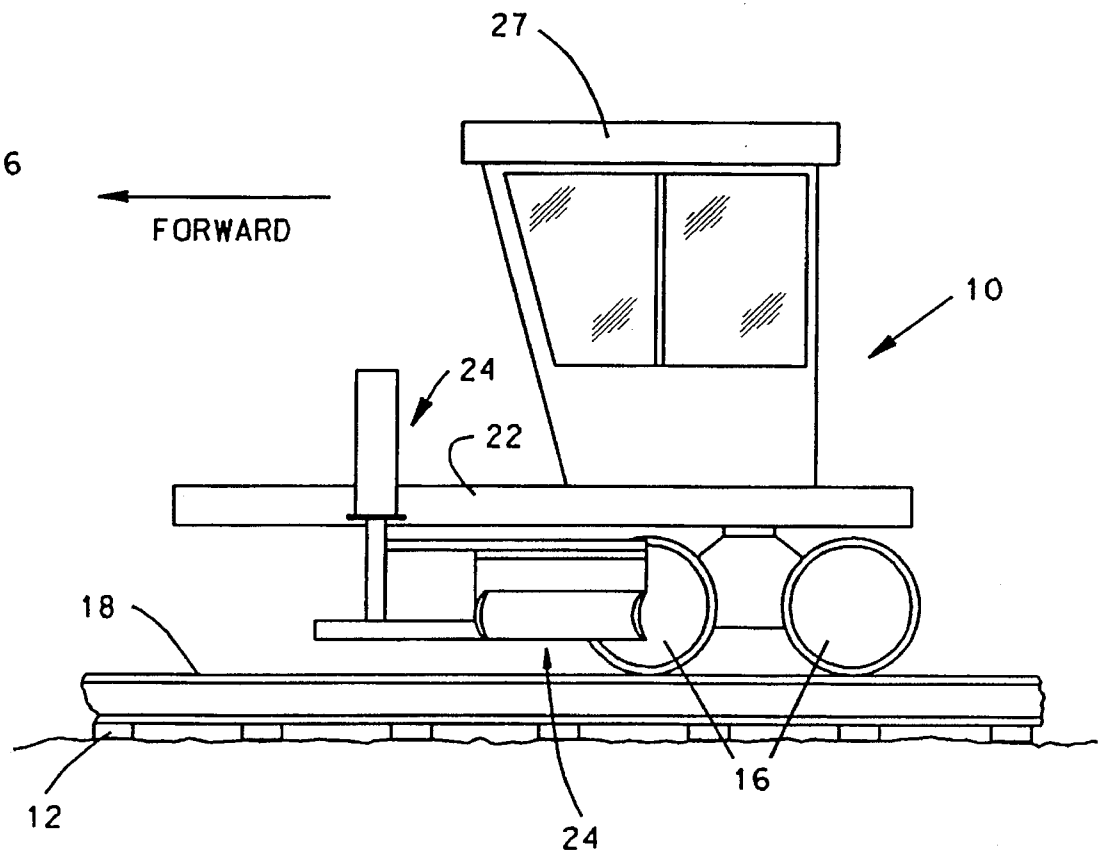
FIG. 2 is a side elevational view of the ballast shoulder cleaner machine of FIG. 1.

FIG. 2 is a side elevational view of machine 10 showing the blade assembly of the ridge plow 24 being in "folded" relation adjacent to the side of frame 22 of the machine. Typically, in this position, the ridge plow is "stowed" as the machine is transported along the rails.

Figure 6:
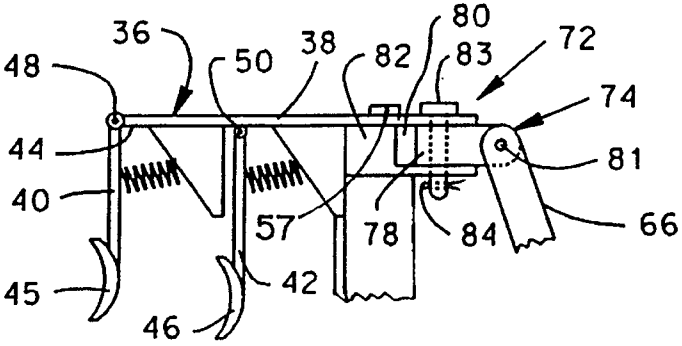
FIG. 6 is an enlarged end view of the ridge plow blade assembly illustrating the pivot joints which permit the up-down, retracted, and extended movement of the blade assembly of the tie plow.
Figure 3:
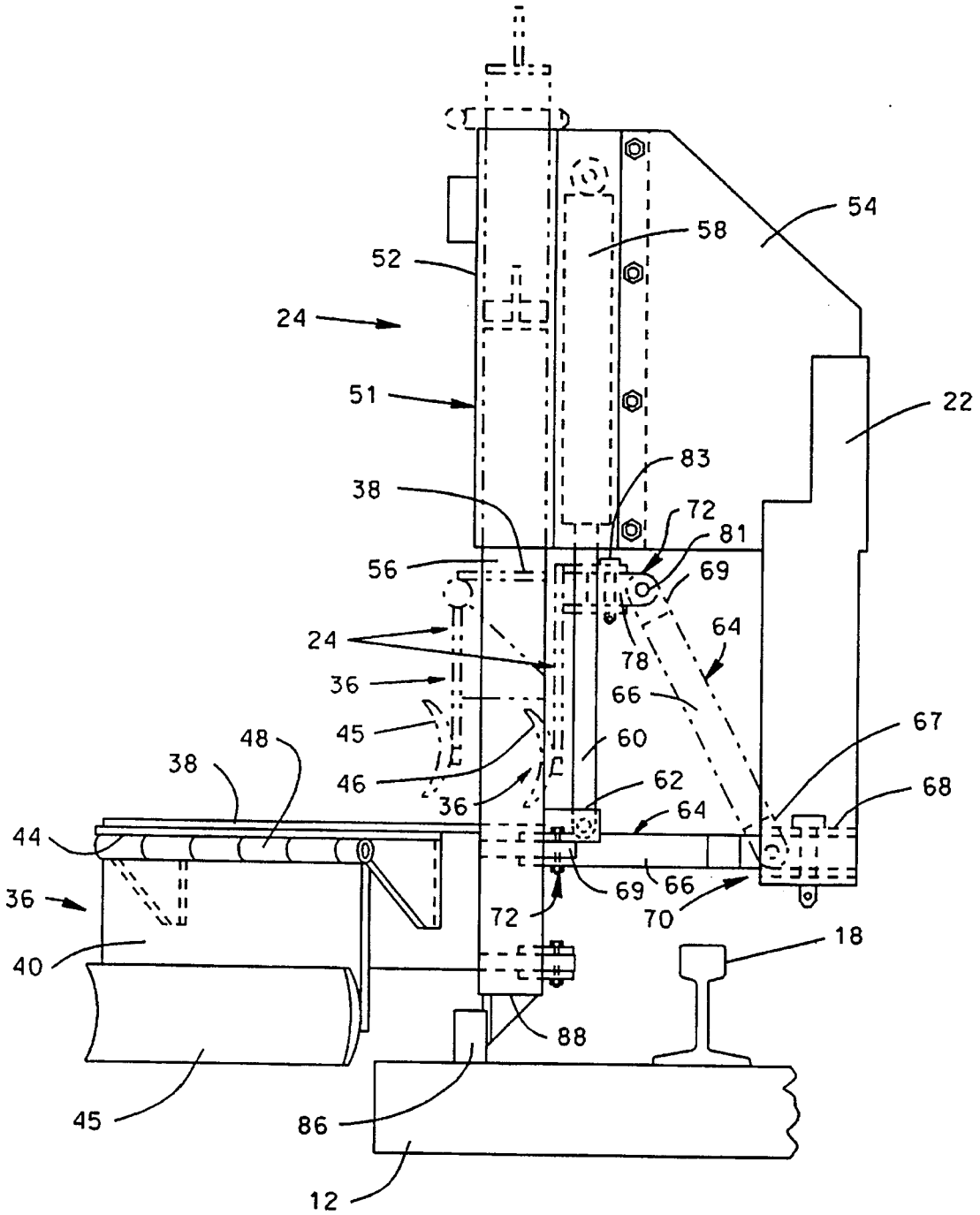
FIG. 3 is a front elevational view of a ridge plow shown in FIG. 1. Phantom lines indicate the position of the ridge plow in the "up" stowed position, and solid lines indicate the plow in the "down" operational position. The assembly is shown with a rail and cross tie to illustrate the relative positions thereof.
Figure 4:
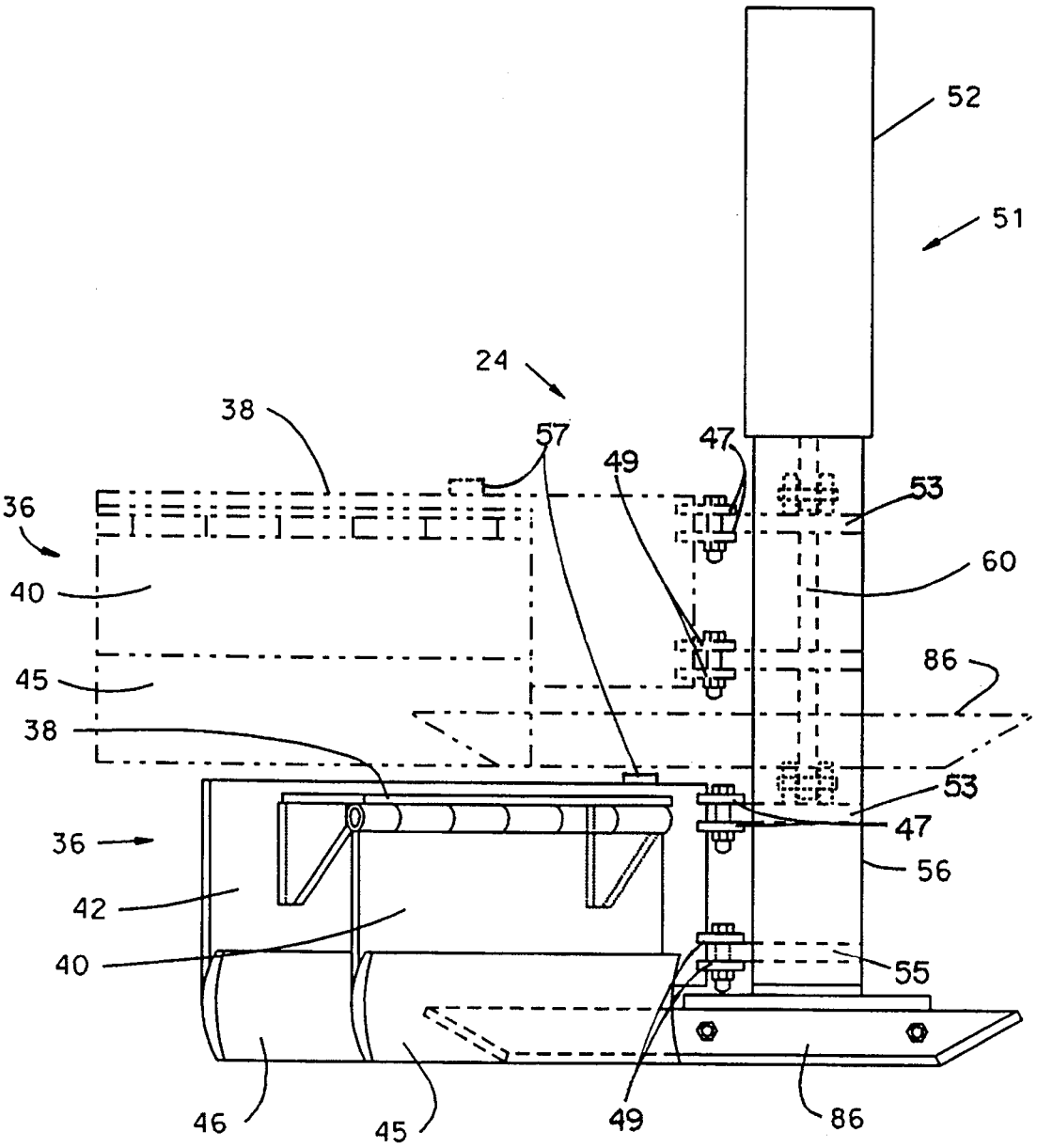
FIG. 4 is a side elevational view of the ridge plow assembly. Phantom lines illustrate the tie plow assembly in the "up and in" stowed position (similar to FIG. 1), and solid lines illustrate the tie plow assembly in the "down and out" operational position.
Figure 5:
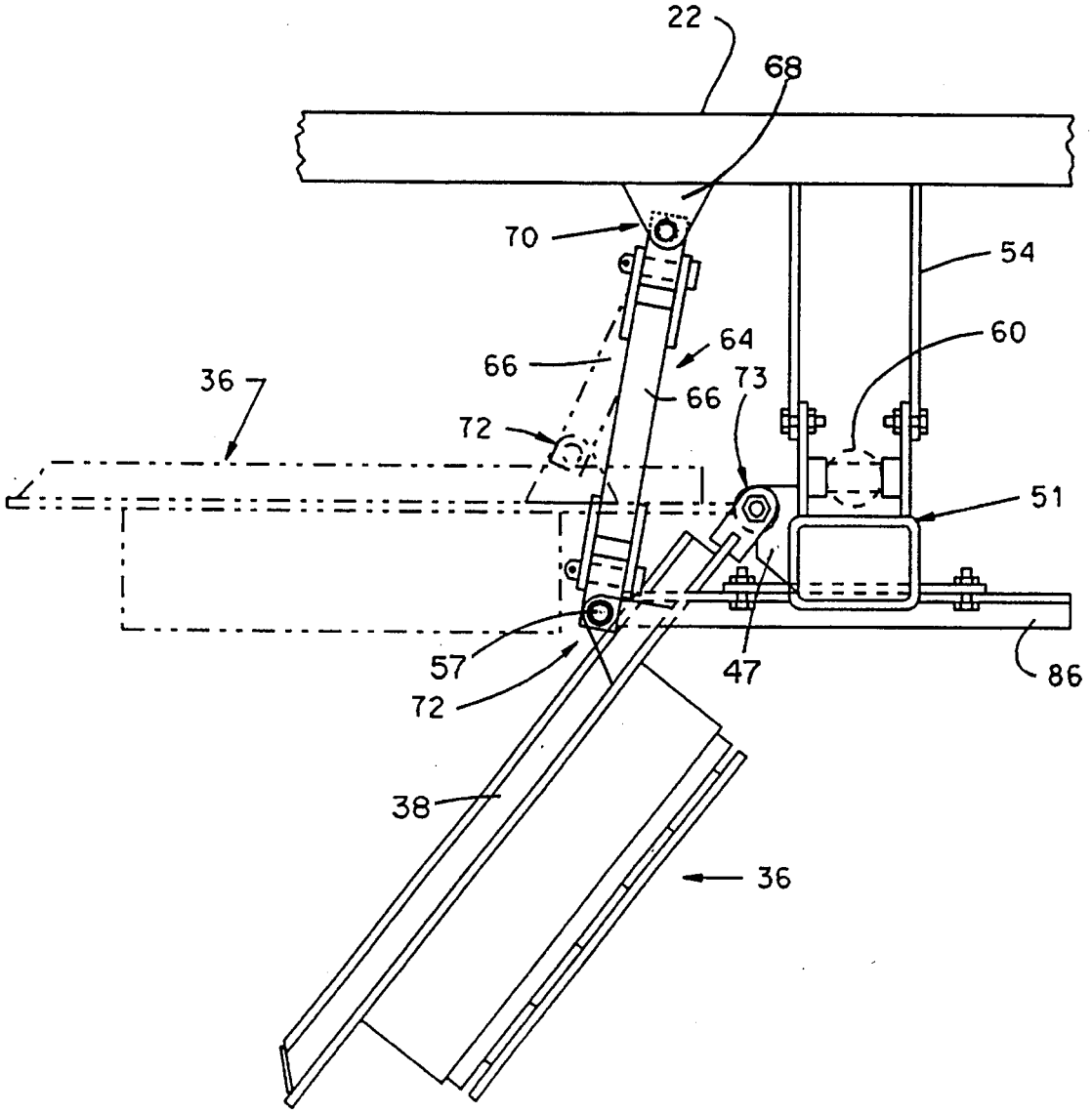
FIG. 5 is a plan view of the tie plow assembly of FIG. 1. Solid lines indicate the plow in the "out and down" position, and phantom lines indicate the plow in the "up and in" position.

FIGS. 3–6 are views illustrating various aspects and operational features of the ridge plow of the present invention. FIG. 3, for example, is a front view of a ridge plow 24 and illustrates one of the blade assemblies 36 of a ridge plow in an "out and down" position in solid lines. The blade assembly is also illustrated in the "up and in" position in dot-dash (phantom) lines. Ridge plow 24 is shown to include blade assembly 36 as having an upper support plate 38 for supporting a pair of blade support members 40 and 42 (FIG. 6) which depend from the lower surface 44 of plate 38. Blade support members 40 and 42 are provided with arcuate, easily removable blades 45 and 46, respectively. As seen in FIG. 6, blade support members 40 and 42 are pivotally mounted to support plate 38 by hinge mechanisms 48 and 50. A slider box 51 (FIG. 3) is provided to support blade assembly 36 and includes an upper section 52 which is rigidly secured to the frame 22 of machine 10 by a bracket 54 and an inner slidable upper section 56 which is slidably movable in upper section 52 by a hydraulic cylinder assembly 58. Cylinder assembly 58 includes a piston having a piston rod 60 extending therefrom. The distal end 62 of the piston rod is secured to slidable section 56 of slider box 51.

To secure each of the blade assemblies 36 to the slidable section 56 of slider box 51, each of the blade assemblies 36 is provided with pairs of extending members which extend from each of the blade assemblies to be pivotally secured to brackets 47 and 49 (FIGS. 4 and 5) which are secured in spaced relation to slidable section 56 of slider box 51. A bracket 57 (FIGS. 4, 5, and 6) is secured to upper plate 38 of each blade assembly 36 to pivotally connect an actuating linkage assembly 64 thereto. Linkage assembly 64 is provided to move the blade assembly 36 between a first position in which it is "folded" (substantially parallel) adjacent to the side of the frame of machine 10 and a second position in which it is extended outwardly from the side of the frame of machine 10 and in angular relation therewith.

Linkage assembly 64 (FIGS. 3 and 5) includes a solid elongated member 66 having one end 67 disposed in pivotal relation with a bracket 68 which is secured to frame 22. This pivoted connection is generally indicated by the numeral 70. The second end 69 of member 66 is shown to be pivotally connected to the upper plate 38 of blade assembly 36. This pivoted joint is generally indicated by the numeral 72. Blade assembly 36 is pivotally connected to brackets 47 and 49 of slidable section 56 by a pivot joint generally designated by the numeral 73 in FIG. 5.

The pivot joints 70 and 72 are similar and are more clearly illustrated in FIG. 6. As seen in FIG. 6, the pivot joint 72 (which is also illustrative of joint 70) is shown to be comprised of a first joint 74 which pivotally secures member 66 to a member 78 by a pin 81. Pin 81 is secured in members 66 and 78 by a cotter pin 84. Member 78 extends into a slot 80 provided in a bracket 82 which is secured to blade assembly 36. Member 78 is pivotally secured in member 82 by a pin 83 having a cotter pin 84 secured thereto. By this arrangement, it can be appreciated that blade assembly 36 may be pivoted in two different directions about joint 70 and in two different directions about joint 72 in response to up and down movement of section 56 in section 52 of slider box 51.

A skid member 86 is secured to the distal end 88 of section 56 of the slider box to further prevent damage from occurring to the blades as they are moved along the railroad bed. The skid is arranged to slide across the upper surfaces of the cross ties, and upon engaging any obstruction (inadvertently raised surfaces, etc.), the skid is raised, which in turn raises the slidable section 56 of the slider box and the blade assembly 36. This can be accomplished because when the section 56 is in its extended position, no hydraulic pressure is being exerted by the piston. The skid essentially "floats" across the upper surfaces of the cross ties until an obstruction is encountered.

The linkage assembly requires a particular geometry to pivot the plow from its raised position (where the plow is parallel to the track and in the clear for track travel) to its lowered position (where the plow is swung outward at the correct angle for plowing the ballast out). This is possible because the raise/lower cylinder moves the plow a predetermined distance from its raised position to its lowered position. The special geometry required means that there has to be a specific relationship between the length of the link, the exact location of the link pivot point on the machine mainframe, and the exact location of the link pivot point on the movable plow.

As a result of this particular linkage geometry, blade assembly 36 automatically swings out to the working position as hydraulic cylinder rod 60 extends from hydraulic cylinder assembly 58. This happens automatically because linkage 64 holds pivot point 70 on the frame a predetermined distance (the length of the link) from pivot point 74 on movable blade assembly 36. As male slider box 56 moves downward, along with blade assembly 36 (to which it is mounted), pivot joint 72 also moves down. Pivot joints 70 and 72 would get much closer together as this happens if link 64 did not hold the predetermined distance. But, because of link 64, pivot joint 72 on blade assembly 36 moves outward, thereby pushing blade assembly 36 outward. When cylinder rod 60 extends until plow assembly 36 is down into its working position, link 64 will push pivot joint 72 outward, pivoting blade assembly 36 outward until it is in its correct working position for plowing the ballast.

When cylinder rod 60 retracts, the reverse action takes place. Male slider box 56 moves upward, lifting blade assembly 36. Pivot joint 72 on blade assembly 36 is pulled in by link 64, which is attached to pivot joint 70 on the frame.

All of the in/out pivoting action of blade assembly 36 takes place because one pivot joint 70 on the frame is stationary and the other pivot joint 72 is on movable plow assembly 36 and thereby goes up and down as cylinder rod 60 moves male slider box 56 and blade assembly 36 up and down. The two pivot joints 70 and 72 must stay a specified distance apart because of rigid link 64 which is connected at points 70 and 72.

I claim:

1. A track working machine for dressing ballast of a railroad bed having cross ties thereon for supporting a pair of spaced tracks having inner and outer surfaces, said cross ties including an upper surface and end portions extending away from said outer surfaces of said track, said machine including a frame and ballast dressing apparatus secured to said frame, said ballast dressing apparatus comprising:

at least one ballast ridge plow assembly mounted on said frame, said ridge plow assembly including a vertically and horizontally movable blade assembly having at least one blade for engaging said ballast;

a single actuating assembly carried by said frame for vertical up and down movement of said blade assembly; and linkage means connected to said frame and to said blade assembly, said linkage means disposed for extending said blade assembly outwardly from and in predetermined angular relation with said frame solely as a result of said downward movement of said blade assembly by said single actuating assembly and for retracting said blade assembly against said frame solely as a result of upward movement of said blade assembly by said single actuating assembly.

2. Apparatus as set forth in claim 1 wherein said single actuating assembly includes a first member secured to said frame of said machine, and a second member slidably mounted in said first member, said second member having a distal end extending out of said first member for secured relation with said blade assembly, and means for imparting vertical sliding movement to said second member in said first member.

3. Apparatus as set forth in claim 2 including one ballast plow assembly secured to said frame on opposite sides of said machine.

4. Apparatus as set forth in claim 2 wherein said linkage assembly includes an elongated member having first and second ends, said first end of said elongated member having an extending member secured in pivotal relation therewith for movement in a first plane, said blade assembly having an upper support member having an extending portion provided with a recess therein to receive said extending member, and means for pivotally securing said blade assembly to said extending member for movement in a second plane substantially normal to said first plane.

5. Apparatus as in claim 4 wherein said second end of said elongated member is provided with an extending member disposed in pivotal relation therewith for movement in a first plane, said extending member extending from said elongated member, said upper support member of said blade assembly having an extending portion provided with a recess therein to receive said extending member, and means for pivotally securing said extending portion of said blade assembly to said extending member for movement in a second plane normal to said first plane.

6. Apparatus as set forth in claim 4 including means for detecting obstructions to the movement of said blade assembly along said railroad bed and for lifting said blade assembly off said railroad bed to clear said obstructions responsive to detection thereof.

7. Apparatus as set forth in claim 6 wherein said means for detecting obstructions and lifting said blade assembly is a ballast-engaging member secured to the distal end of said second member, said ballast-engaging member disposed for substantially "floating" relation along said railroad bed to substantially ride over said obstructions and lift said blade assembly in response thereto.

8. Apparatus as set forth in claim 1 including biasing means for permitting pivotal flexing movement of said at least one blade responsive to impact of said blade with undesirable obstructions.

9. Apparatus as set forth in claim 8 wherein said biasing means is a compression spring for exerting a force against said at least one blade.

10. Apparatus as set forth in claim 9 wherein said blade assembly includes at least one plate member extending downwardly from said upper support member, and said compression spring is mounted between said blade and said at least one plate member secured to said upper support member.

11. Apparatus as set forth in claim 8 including a pair of blades extending downwardly from said upper support member, said blades disposed in spaced relation, and each said blade being provided with said biasing means for permitting pivotal flexing movement of each of said pair of blades.

12. Apparatus as set forth in claim 1 wherein said blade assembly includes a blade assembly support member provided with upper and lower surfaces and means for pivotally securing said blade assembly support member to said actuating means for vertical up and down movement of said blade assembly.

13. Apparatus as set forth in claim 12 including at least one blade support member having first and second ends, said first end pivotally secured to said lower surface of said blade support member, said second end having a removable blade secured thereto.

14. A track working machine for dressing ballast of a railroad bed having cross ties thereon for supporting a pair of spaced tracks having inner and outer surfaces, said cross ties including an upper surface and end portions extending away from said outer surfaces of said track, said machine including a frame and ballast dressing apparatus secured to said frame, said ballast dressing apparatus comprising:

at least one ballast ridge plow assembly mounted on said frame, said ridge plow assembly including a vertically and horizontally movable blade assembly having at least one blade for engaging said ballast;

a single actuating assembly carried by said frame for vertical up and down movement of said blade assembly, said single actuating assembly including a slider box defined by an outer housing having an inner member slidably mounted therein and a fluid actuator secured to said outer housing and having a piston actuated piston rod mounted to vertical movement therein, the distal end of said piston rod being secured to said slidable member of said slider box for vertical movement thereof; and linkage means connected to said frame and to said blade assembly, said linkage means disposed for extending said blade assembly outwardly from and in predetermined angular relation with said frame in response to said downward movement of said blade assembly by said inner member of said slider box and for retracting said blade assembly against said frame in response to upward movement of said inner member of said slider box by said single actuating assembly.

* * * * *